US006364460B1

(12) United States Patent
Sager

(10) Patent No.: US 6,364,460 B1
(45) Date of Patent: Apr. 2, 2002

(54) LIQUID DELIVERY SYSTEM

(76) Inventor: Chad R. Sager, 1270 Conrad Sauer, Suite 106, Houston, TX (US) 77043

( * ) Notice: Subject to any disclaimer, the term of this patent is extended or adjusted under 35 U.S.C. 154(b) by 0 days.

(21) Appl. No.: 09/728,274

(22) Filed: Dec. 1, 2000

Related U.S. Application Data

(60) Provisional application No. 60/211,305, filed on Jun. 13, 2000.

(51) Int. Cl.[7] ..... B41J 2/04
(52) U.S. Cl. ..... 347/54
(58) Field of Search ..... 347/54, 68, 69, 347/70, 71, 72, 50, 40, 47, 92; 399/271; 361/700; 310/328–330; 29/890.1

(56) References Cited

U.S. PATENT DOCUMENTS

| | | | |
|---|---|---|---|
| 4,825,227 | A | 4/1989 | Fischbeck et al. |
| 5,164,740 | A | 11/1992 | Ivri |
| 5,200,768 | A | 4/1993 | Shibaike et al. |
| 5,426,070 | A | 6/1995 | Shaw et al. |
| 5,506,175 | A | 4/1996 | Zhang et al. |
| 5,534,900 | A | 7/1996 | Ohno et al. |
| 5,563,343 | A | 10/1996 | Shaw et al. |
| 5,610,335 | A | 3/1997 | Shaw et al. |
| 5,640,133 | A | 6/1997 | MacDonald et al. |
| 5,684,519 | A | 11/1997 | Matoba et al. |
| 5,719,073 | A | 2/1998 | Shaw et al. |
| 5,767,877 | A | 6/1998 | Mei et al. |
| 5,786,621 | A | 7/1998 | Saif et al. |
| 5,804,083 | A | 9/1998 | Ishii et al. |
| 5,846,396 | A | 12/1998 | Zanzucchi et al. |
| 5,846,849 | A | 12/1998 | Shaw et al. |
| 5,847,454 | A | 12/1998 | Shaw et al. |
| 5,850,241 | A | 12/1998 | Silverbrook |
| 5,862,003 | A | 1/1999 | Saif et al. |
| 5,909,230 | A | 6/1999 | Choi et al. |
| 5,958,344 | A | 9/1999 | Levine et al. |
| 5,984,446 | A | 11/1999 | Silverbrook |
| 5,992,820 | A | 11/1999 | Fare et al. |
| 6,025,767 | A | 2/2000 | Kellam et al. |
| 6,033,544 | A | 3/2000 | Demers et al. |
| 6,046,066 | A | 4/2000 | Fang et al. |
| 6,051,866 | A | 4/2000 | Shaw et al. |
| 6,060,336 | A | 5/2000 | Wan |

FOREIGN PATENT DOCUMENTS

| | | |
|---|---|---|
| WO | WO 99/03680 A1 | 1/1999 |
| WO | WO/99/03681 A1 | 1/1999 |

OTHER PUBLICATIONS

Sensors and Actuators, vol. 20, pp. 25–32 (1989).
Tang, et al., Laterally Driven Polysilicon Resonant Microstructures, Sensors and Actuators, 20(1989) 25–32.

*Primary Examiner*—Raquel Yvette Gordon
(74) *Attorney, Agent, or Firm*—Cook, Alex, McFarron, Manzo, Cummings & Mehler, Ltd.

(57) ABSTRACT

A liquid delivery system that is fabricated on a substrate that comprises at least one liquid source and a chamber including a nozzle with an outlet through which liquid is expelled from the system. A micro channel connects the liquid source to the chamber, and a pump transports liquid from a liquid source to the chamber. A moveable member is provided for applying positive pressure to the liquid in the chamber, so as to force a metered amount of liquid through the outlet of the nozzle. A reciprocating mass is operatively connected to the moveable member to move it back and forth. In one embodiment, the moveable member is a generally 3-sided, U-shaped structure having spaced-apart sides, each of which is sized and shaped to fit through the outlet of the nozzle. A third side connects the spaced-apart sides to each other, and the entire structure is reciprocable between a first position inside the chamber and a second position outside the nozzle. As the structure moves from the inside of the nozzle through the outlet, a liquid film forms on the open area defined by the structure, and liquid in excess of that needed to form the film forms a drop.

11 Claims, 8 Drawing Sheets

LIQUID DELIVERY SYSTEM

CROSS REFERENCE TO RELATED APPLICATION

This application claims the benefit of provisional application Ser. No. 60/211,305, filed Jun. 13, 2000.

BACKGROUND OF THE INVENTION

The present invention relates to a liquid delivery system and, more particularly, to a liquid delivery system that is capable of repeatedly delivering a small amount of precisely metered liquid.

Devices for delivering precisely measured or metered minute amounts of liquids have a wide range of applications, ranging from ink jet printing to drug administration and combinatorial chemistry (See, e.g., Demers et al., U.S. Pat. No. 6,033,544). In ink jet printing alone, it is estimated that nearly 120 million ink jet cartridges were sold in 1998 in the United States, and the size of the worldwide market is predicted to more than double by 2003.

Presently, most commercially-available ink jet print heads employ either a piezoelectric crystal, to which a high voltage is applied to cause the crystal to deform and apply pressure on an ink reservoir, or electrothermal drop ejection, in which the ink is rapidly heated to a high temperature to evaporate a small quantity of ink. The vaporized ink forms a bubble that creates a pressure wave within the ink reservoir that forces drops of ink to be ejected. While these technologies have generally functioned well, they also have shortcomings that limit their desirability. For example, piezoelectric printing mechanisms require highly complex circuitry and bulky crystal arrays that make batch fabrication difficult. On the other hand, thermal ink jets require greater power consumption to heat the ink, and only special aqueous inks may be used. Both piezoelectric and thermal technologies facilitate drop delivery at a frequency of about 12 kHz and a volume of generally greater than 3 pL, which puts a limit on improvements to print speed and print resolution.

Thus, there remains a need for an improved liquid delivery system which may be advantageously used in a wide variety of applications, including ink jet printing.

It is a further object to provide such a liquid delivery system that is subject to batch fabrication techniques.

An additional object of the present invention is to provide a liquid delivery system that is capable of delivering liquid at a greater frequency and in smaller quantities than currently available technologies.

SUMMARY OF THE INVENTION

These objects, as well as others which will become apparent upon reference to the following detailed description and accompanying drawings, are provided by a liquid delivery system that is fabricated on a substrate that comprises at least one liquid source and a chamber including a nozzle with an outlet through which liquid is expelled from the system. A microchannel connects the liquid source to the chamber, and a pump transports liquid from a liquid source to the chamber. A moveable member is provided for applying positive pressure to the liquid in the chamber, so as to force a metered amount of liquid through the outlet of the nozzle. A reciprocating mass is operatively connected to the moveable member to move it back and forth.

In one embodiment, the moveable member is a generally 3-sided, U-shaped structure having spaced-apart sides, each of which is sized and shaped to fit through the outlet of the nozzle. A third side connects the spaced-apart sides to each other, and the entire structure is reciprocable between a first position inside the chamber and a second position outside the nozzle. As the structure moves from the inside of the nozzle through the outlet, a liquid film forms on the open area defined by the structure, and liquid in excess of that needed to form the film forms a drop.

In a second embodiment, the moveable member comprises a 4-sided, generally rectangularly-shaped structure with opposed open sides. Two of the opposing sides are sized and shaped to fit through the outlet of the nozzle, while the other two opposing sides connect the first two opposing sides. The structure is reciprocable by the moveable member between a first position inside the chamber and a second position outside the chamber. As the structure moves through the outlet of the nozzle, a liquid film forms across the open sides and the liquid in excess of that required to form the film forms a drop.

In a third embodiment, the liquid delivery system includes a valve that substantially seals the chamber from the microchannel, and the moveable member comprises a generally flat plate. The bottom side of the plate is submerged beneath the surface of the liquid in the chamber, and the flat plate is reciprocable between a first position in which no force is exerted by the plate on the surface of the liquid to a second position in which a force is exerted on the surface of the liquid. The surface tension of the liquid with respect to the top edge of the plate is such that, as the plate exerts pressure on the liquid, liquid does not move across the top edge of the plate onto the top side of the plate, and liquid is forced out of the chamber through the nozzle.

In a fourth embodiment, the moveable member includes a portion that seals the microchannel from the chamber as the moveable member moves from a first position to a second position where liquid is forced through the outlet of the nozzle.

In a fifth embodiment, the liquid delivery system includes at least one valve to seal the chamber from the microchannel, and the moveable member comprises a tapered plunger, the outlet of the chamber having an outlet of a shape complimentary to the plunger.

In a sixth embodiment, the liquid delivery system includes a nozzle that has edges which are engaged by the moveable member. The moveable member comprises a flat plate sized so that as the plate passes through the chamber, the plate engages the edges of the nozzle to seal the nozzle from the microchannel. Flexing of the flat plate after it engages the edges of the nozzle causes liquid to be expelled through the outlet of the nozzle.

In a seventh embodiment, the moveable member of the liquid delivery system is an elongated member having an axis along its length and a first end that secured to a support interior of the chamber and a second free end. The elongated member is moveable between a first position spaced-apart from the nozzle to a second position closely overlying the nozzle so that a metered amounted of liquid is forced through the nozzle as the elongated member moves from its first position to its second position. The reciprocating mass may be operatively connected to the free end of the elongated member so as to apply a force either perpendicular to the axis or in line with the axis.

Each of the embodiments is on a scale such that surface tension dominates over gravitational forces. This allows the liquid delivery system to be oriented in any reasonable direction in relation to the local gravitational field.

It is contemplated that the liquid delivery system of the present invention will be fabricated by micromachining using any of the well-known processes. As disclosed, the liquid delivery system uses micro-electro-mechanical structures, popularly known as MEMS for actuating the moveable member.

The devices employ microchannels of capillary dimensions, that is they favor capillary flow of liquid, with a barrier to fluid flow out of the system due to the formation by the liquid of an energy-minimizing surface such as a meniscus.

DETAILED DESCRIPTION OF THE PREFERRED EMBODIMENTS

Figure 1:
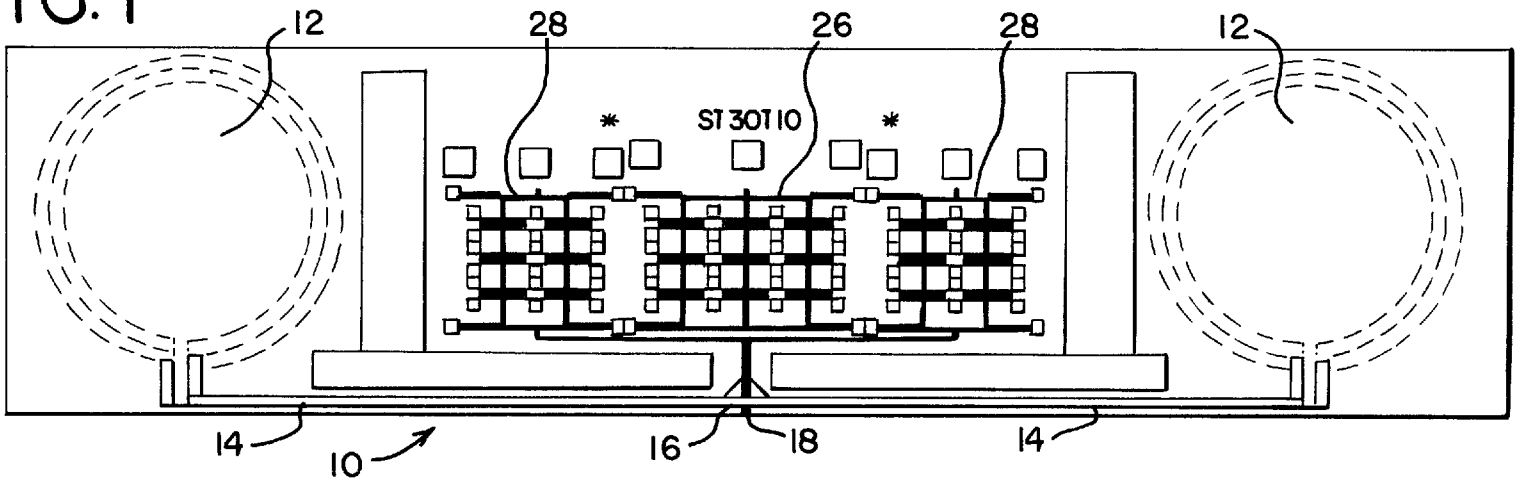
FIG. 1 is a diagrammatic view of a liquid delivery system according to the present invention.

Turning to the figures of the drawing, there is seen in FIG. 1 a schematic representation of a liquid delivery system 10 according to the present invention. The liquid delivery system 10 is adapted to be made by batch processing on single crystal silicon by well-known micromachining processes, with a glass cover (not shown) sealing the top.

One manufacturing technique that may be advantageously used is reactive ion etching. See, e.g., Shaw et al., U.S. Pat. No. 6,051,866, incorporated by reference herein, which discloses a single mask, low temperature reactive ion etching process for fabricating high aspect ratio, released single crystal MEM structures independently of crystal orientation. This process is known by the acronym SCREAM, which stands for "single crystal reactive etching and metalization." See also, Shaw et al., "SCREAM I" A Single Mask, Single Crystal Silicone Reactive Ion Etching Process for Microelectromechanical Structures," *Sensors and Actuators,* A40, pp. 63–70 (1994).

Returning to FIG. 1, the illustrated liquid delivery system 10 includes a pair of liquid sources or reservoirs 12, each connected by a microchannel 14 to a chamber 16 that includes a nozzle 18 (both of which are better seen in FIGS. 2–7) at a lateral edge of the silicon wafer adjacent the microchannels. A precisely metered amount of liquid is expelled from the liquid delivery system 10 through the outlet of the nozzle 18.

Any of a variety of pumping structures (not shown) of suitable dimension may be used to transport the liquid from the reservoirs 12 to the chamber 16. Such pumps may themselves incorporate MEMS, see, e.g., Esashi et al., "Normally Closed Microvalve and Pump Fabricated on a Silicon Wafer," *Sensors and Actuators,* 20, pp. 163–169 (1989). The pumps may comprise electrode-based pumps, such as the electrohydrodynamic (EHD) pumps or electroosmosis (EO) pumps which are described by Bart et al., "Microfabricated Electrohydrodynamic Pump," *Sensors and Actuators,* A21–A23, pp. 193–197 (1990), and Dasgupta et al., "Electroosmosis: A Reliable Fluid Propulsion System for Flow Injection Analysis," *Anal. Chem.,* 66 pp. 1792–1798 (1994).

A "pump end" or moveable member 22 (best seen in FIGS. 2–7) is provided for applying a positive pressure to the liquid in the chamber 16 so as to force a metered amount of liquid through the outlet of the nozzle 18. The moveable member 22 is operatively connected by a connecting rod 24 to an actuator 26 which acts as a mass that reciprocates the moveable member 22 back and forth within or through the chamber. Certain embodiments may require additional actuators 28 that operate valves that seal the chamber 16 from the microchannel 14.

The various actuators 26 or 28 for the liquid delivery system 10 are preferably comprised of electrostatic interdigitated finger or comb structures, the design and fabrication of which are set forth in Tang et al., "Laterally Driven Polysilicon Resonant Microstructures," *Sensors and Actuators,* 20, pp. 25–32 (1989). Such actuators typically include a moveable portion and a fixed portion supported by a set of springs formed from released longitudinal beams. The motion of the moveable portion deforms the springs. The force required to deform the springs (and thus move the actuator) is obtained by the use of the comb capacitors. See, e.g., Zhang et al., U.S. Pat. No. 5,506,175, incorporated by reference herein.

Advantageously, a micromotion amplifier, such as that disclosed in Saif et al., U.S. Pat. No. 5,862,003, incorporated by reference herein, may be used as part of the actuator. Saif et al. disclose an amplifier that employs a long, slender beam supported at each end. A controlled amplified lateral motion of the beam is obtained in response to a small deformation in the axial direction of the beam, i.e., the lateral motion is the result of the buckling of the beam under compression. Such a device provides a transverse motion in the range of 50–200 microns in response to a longitudinal motion in the range of 1–5 microns. The beam is fabricated to include at its center point a connecting rod that is connected to the moveable member 22 of the liquid delivery system. Alternatively, controlled amplified motion may be provided by designing the actuators to operate at their natural frequency. When such structures are excited at their natural frequency an amplification of motion is obtained that is dependent on the amount of damping.

Figure 2:
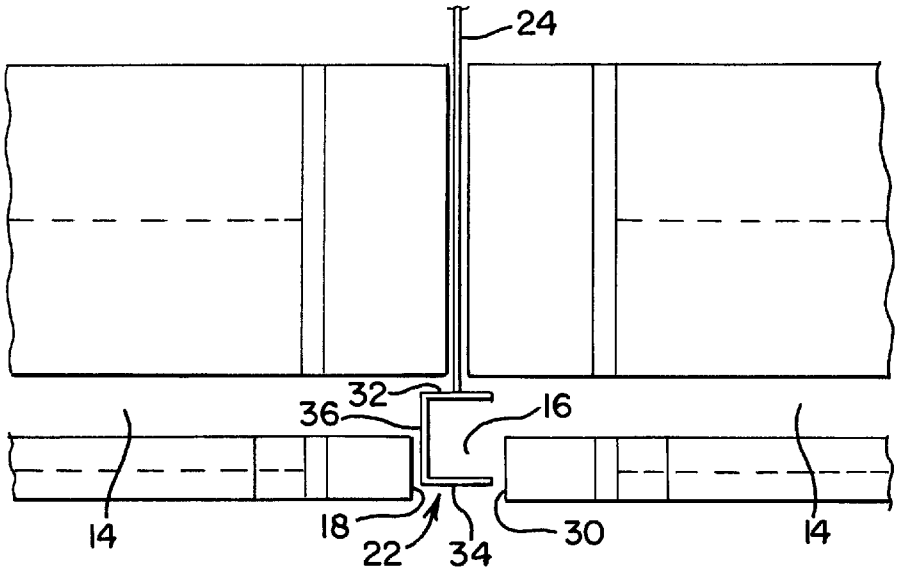
FIG. 2 is an enlarged diagrammatic view of a first pump end embodiment for use in the liquid delivery system of FIG. 1.
Figure 3:
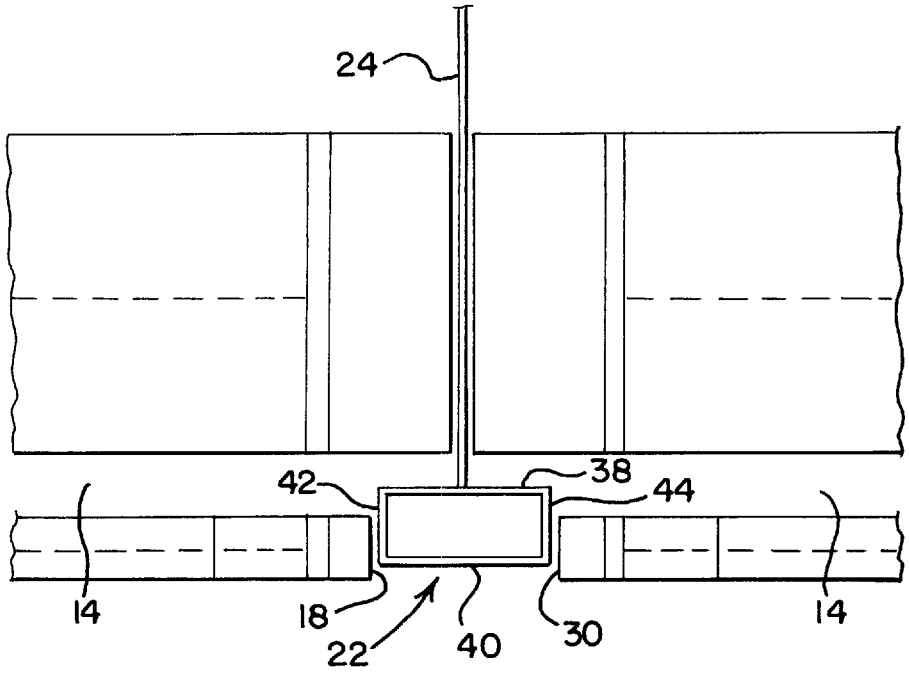
FIG. 3 is an enlarged diagrammatic view of a second pump end embodiment for use in the liquid delivery system of FIG. 1.

Turning to FIGS. 2 and 3, there are seen two similar embodiments of a moveable member 22 for use in conjunction with the present invention. The moveable member 22 resides in the chamber 16 of the liquid delivery system 10 and is sized so that it can move from the interior of the chamber 16 through the outlet 30 of the nozzle 18. The moveable member 22 includes an open-sided structure. As the structure passes through the outlet of the nozzle, a film forms on the open structure (much like a child's wand for blowing soap bubbles). The liquid in excess of that required to form the liquid film forms drop(s) that are delivered to the desired location adjacent the nozzle 18. The moveable member 22 is sized to substantially fill the nozzle 18 so that, as it passes through and out of the outlet 30 of the nozzle 18, the clearance is such that the surface tension of the liquid between the nozzle 18 and the moveable member 22 prevents any additional liquid from passing through the nozzle 18 around the periphery of the moveable member 22.

With specific reference to FIG. 2, the moveable member 22 is generally a 3-sided, U-shaped structure having spaced-apart sides 32 and 34 which are each of a size and shape to fit through the outlet of the nozzle 18. A third side 36 connects sides 32 and 34 to each other in an aligned, parallel relation, and a connecting rod 24 attached to side 32 interconnects the moveable member 22 to the actuator 26. As the moveable member 22 moves through the outlet 30 of the nozzle 18, a film of liquid forms across the U-shaped opening defined by the three sides 32, 34, and 36. Once through the outlet 30, the liquid in excess of that required to form the film drops away from the moveable member 22.

Turning to FIG. 3, an embodiment similar in concept to FIG. 2 is shown. However, instead of the moveable member 22 comprising an open-ended U-shaped structure, it comprises a closed, rectangular-shaped structure with opposed open sides. Sides 38 and 40 are sized and shaped to fit through the outlet of the nozzle 18, much like the sides 32 and 34 of the moveable member of FIG. 2. Sides 42 and 44 connect the lateral edges of sides 38 and 42 to complete the structure. The connecting rod 24 attaches to side 38 to interconnect the actuator 26 to the moveable member 22. Like the embodiment of FIG. 2, as the moveable member 22 moves out of the outlet 30 of the nozzle 18, a film of liquid forms across the open sides of the structure defined by the opposed sides 38, 40, 42, and 44. Once through the outlet 30, the liquid in excess of that needed for form the film drops away from the structure.

Figure 4:
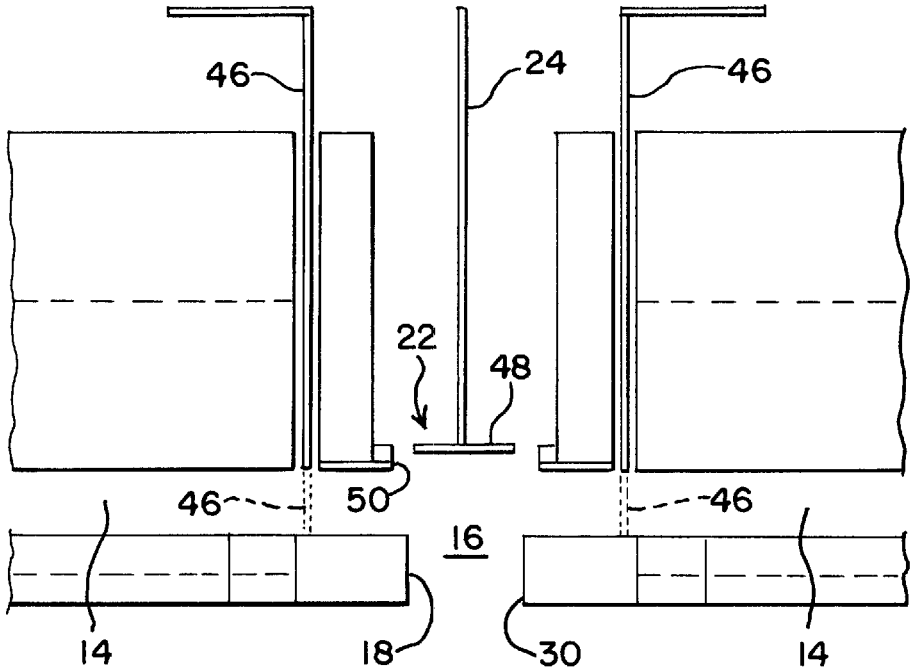
FIG. 4 is an enlarged diagrammatic view of a third pump end embodiment for use in the liquid delivery system of FIG. 1.

With reference to FIG. 4, a further embodiment of the pump end of the liquid delivery system is shown. This embodiment includes two slidable valve members 46 that move between a first, retracted position (as shown) to permit liquid to be pumped from the reservoir 12 to the chamber 16, and a second, extended position (shown in dotted lines) in which the valve members 46 close the microchannels 14 to essentially seal the chamber 16. The moveable member 22 comprises a generally flat plate 48 with the top side being attached by the connecting rod 24 to the actuator 26. The top of the chamber 16 has an opening 50 sized so that the plate can fit therethrough. The plate 48 has top and bottom edges with sharp corners. In its first position, the bottom of the plate 48 engages the surface of the liquid in the chamber 16 at the portion of the chamber 16 opposite the nozzle 18. In this position, the bottom of the plate 48 is submerged beneath the liquid in the chamber 16 and the plate 48 places substantially no force on the liquid. The actuator 26 and connecting rod 24 move the plate 48 toward the nozzle 18. However, due to surface tension of the liquid with respect to the top edge of the plate 48, the liquid does not move across the top edge onto the top surface of the plate 48. Instead, the plate 48 is able to exert a positive pressure on the liquid in the chamber 16 sufficient to force some liquid through the outlet 30 of the nozzle 18. In one embodiment, where the plate 48 measures 100 microns×20 microns×4 microns, the plate 48 can be lowered 30 to 50 microns below the initial surface level of the liquid with a force of approximately 5.2 micro-N (with a theoretical maximum force of 17.3 micro-N), and the plate 48 can be lowered into the liquid a distance of approximately 10 times the thickness of the plate.

Figure 5:
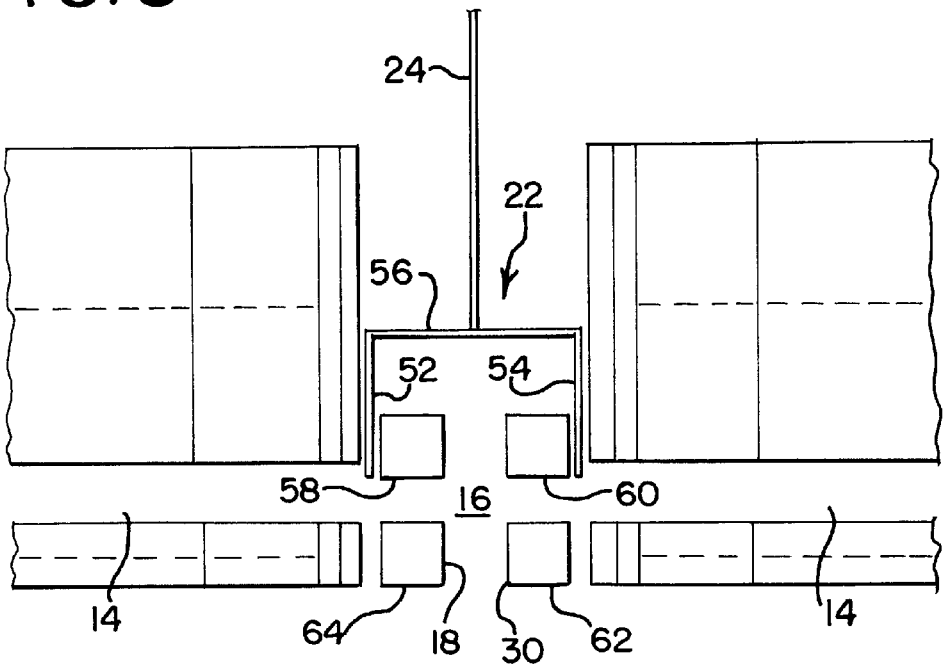
FIG. 5 is an enlarged diagrammatic view of a fourth pump end embodiment for use in the liquid delivery system of FIG. 1.

Turning to FIG. 5, a further embodiment of a liquid delivery system 10 according to the present invention is shown. Like the embodiment of FIG. 4, the embodiment of FIG. 5 incorporates slidable valve members 52 and 54 that move between a first, retracted position (as shown) and a second, extended position in which the valve members 52, 54 seal the chamber 16 from the microchannels 14. However, in contrast to the embodiment of FIG. 4, the valve members 52, 54 of the FIG. 5 embodiment are integral with the moveable member 22. Specifically, the moveable member 22 of the FIG. 5 embodiment comprises a plunger portion in the form of a plate 56 that, as it moves toward the outlet 30 of the nozzle 18 creates a positive pressure on the liquid in the chamber 16. Simultaneously, the valve portions 52 and 54, which are integral with the plunger 56, move across the microchannels 14 to seal them from the chamber 16. In the illustrated embodiment, the wafer includes a series of posts 58, 60, 62, and 64 that serve to direct the flow toward the nozzle as the valve members 52 and 54 seal the chamber and the moveable member 22 reciprocates. The plunger 56 is attached by the connecting rod 24 to the actuator 26 for reciprocal movement. Thus, the positive pressure applied to the fluid in the chamber 16 by the plunger 56 forces the liquid out of the outlet 30, rather than back through the microchannels into the reservoir 12.

Figure 6:
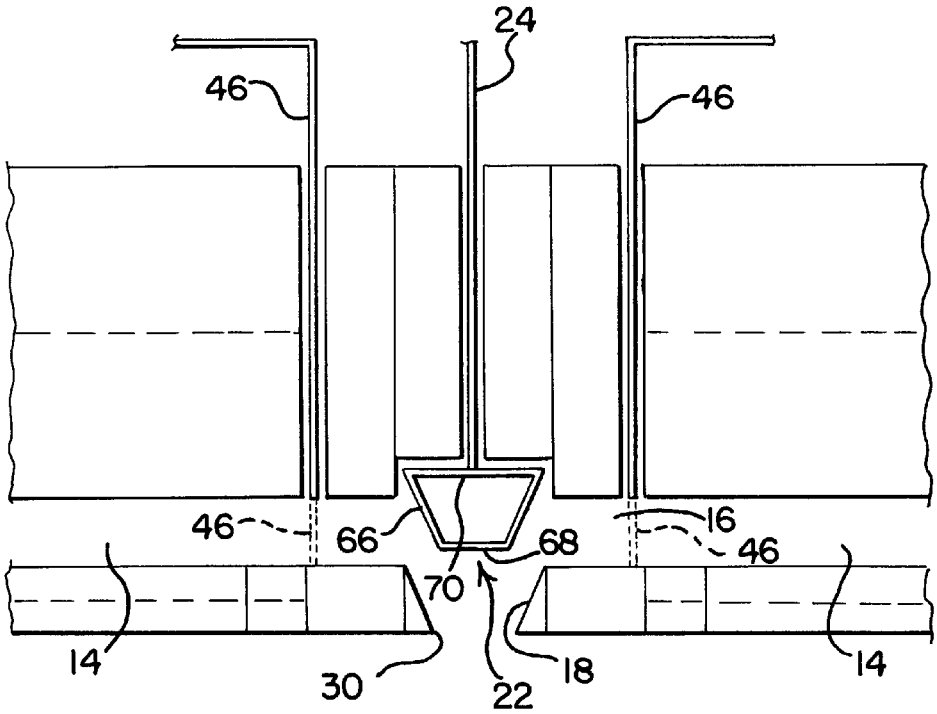
FIG. 6 is an enlarged diagrammatic view of a fifth pump end embodiment for use in the liquid delivery system of FIG. 1.

An additional embodiment of a pump end for a liquid delivery system 10 according to the present invention as shown in FIG. 6. Like the embodiment of FIG. 4, the FIG. 6 embodiment includes two slidable valve members 46 that move between a first, retracted position (as shown) to permit liquid to flow from the reservoirs 12 though the microchannels 14 to the chamber 16, in a second, extended position (shown in dotted lines) in which the valve members 46 close the microchannels 14 to seal the chamber 16. The moveable member 22 of the FIG. 6 embodiment comprises a trapezoidal-shaped plunger 66 with a distal end 68 narrower than the proximal end 70. When fully extended, the plunger 66 nests within a complimentarily shaped nozzle 18. The plunger 66 is attached by a connecting rod 24 to the actuator 26 which reciprocates the plunger 66 within the chamber 16.

Figure 7A:
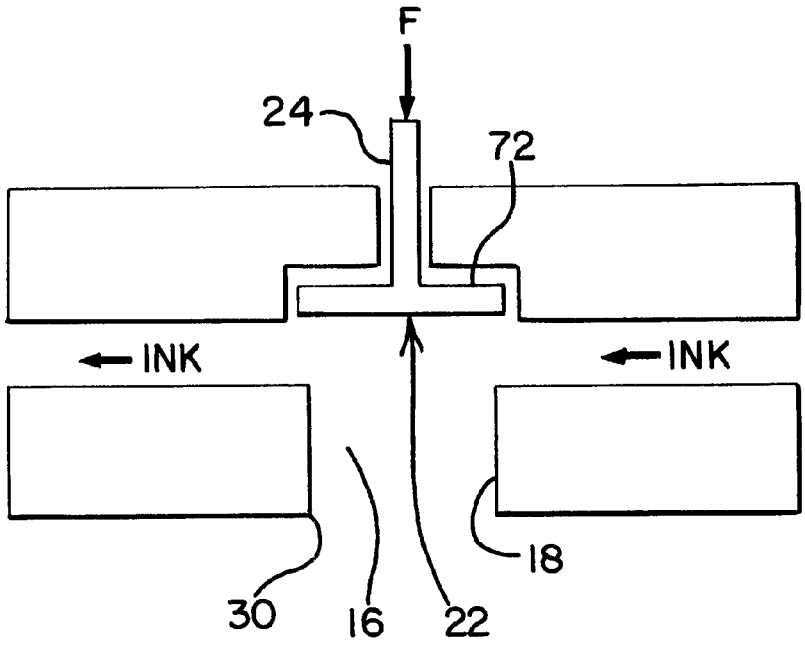
FIGS. 7A and 7B are enlarged diagrammatic views of a sixth pump end embodiment for use in the liquid delivery system of FIG. 1, with FIG. 7B showing the ejection of an ink droplet from the system.
Figure 7B:
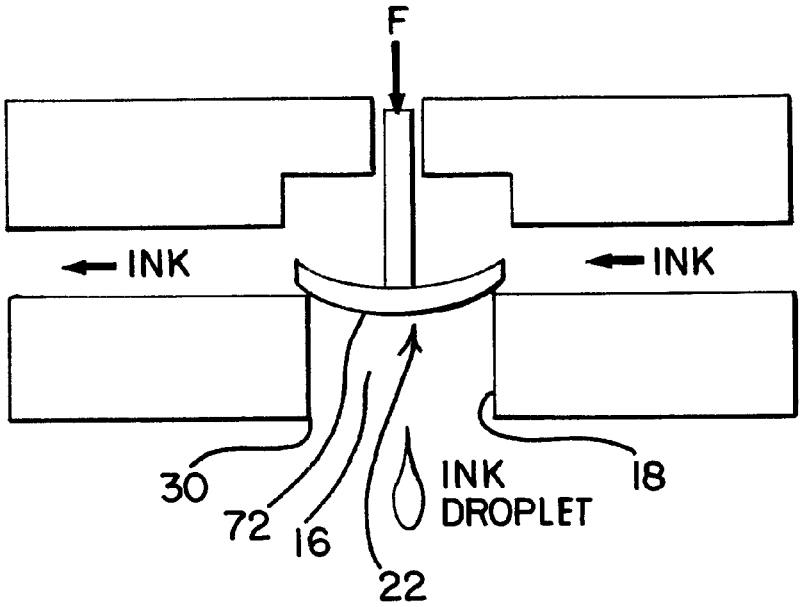

With reference to FIGS. 7A and 7B, an additional embodiment of the pump end of a liquid delivery system 10 according to the present invention is shown. This embodiment includes a plunger 72 in the form of a plate that is attached by the connecting rod 24 to the actuator 26 so as to be moveable between a retracted position (FIG. 7A) and an extended position (FIG. 7B). The plate 72 is sized to be larger than the inlet to the nozzle 18 so that when in the extended position, the peripheral edges of the plate 72 seal the inlet of the nozzle 18 from the microchannels 14. The actuator 26 applies additional force to the plate 72 so that a central portion of the plate 72 flexes toward the interior of the nozzle 18 to exert a positive pressure on the liquid therein and thus force liquid through the outlet 30 of the nozzle 18.

With reference to 8A and 8B, a further embodiment of the pump end of a liquid delivery system according to the present invention is shown. The moveable member 22 is in the form of an elongated member 74 that has a first end 76 that is fixed to a support 78 on the interior of the chamber 16. The connecting rod (not shown) exerts a force on the free end 80 of the elongated member 74 as indicated by the arrow, to move the elongated member 74 angularly from its first position (FIG. 8A), in which it is spaced-apart from the nozzle 18, to a second position (FIG. 8B), in which it closely overlies the nozzle on the interior of the chamber. By this motion, a metered amount of liquid is forced through the opening 30 and the nozzle. As illustrated, the elongated member 74 includes a generally right-angle leg 82 to which the connecting rod is attached in order to apply a force to the elongated member 74 generally perpendicular to the long axis of the elongated member.

Figure 8A:
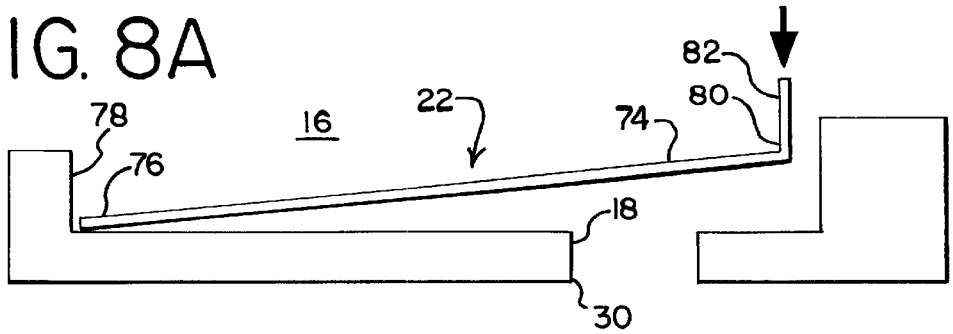
FIGS. 8A and 8B are enlarged diagrammatic views of a seventh pump end embodiment for use in the liquid delivery system of FIG. 1, with FIG. 8B showing the ejection of an ink droplet from the system.
Figure 8B:
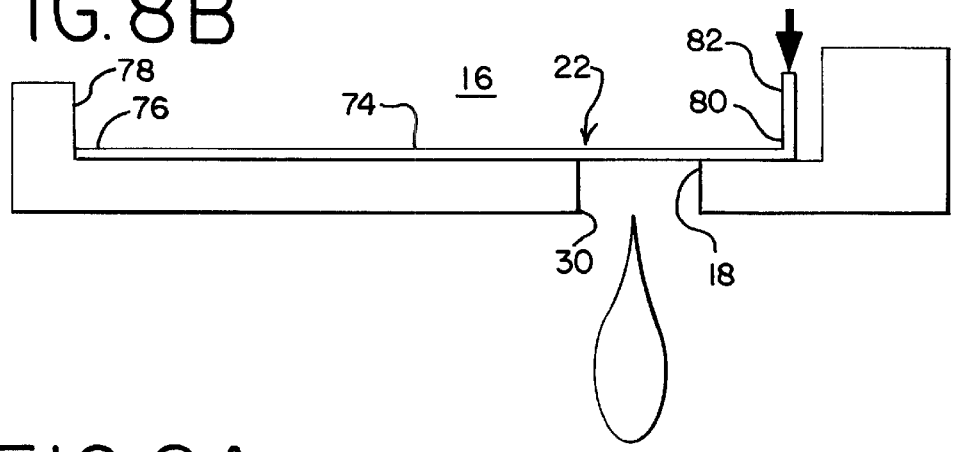
Figure 9A:
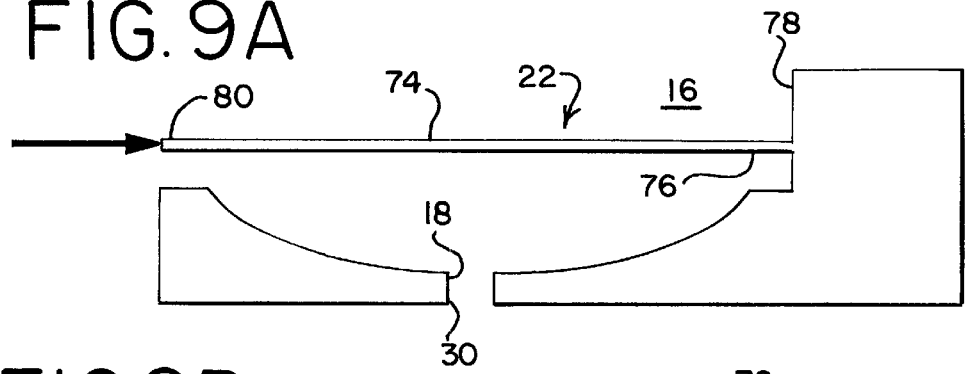
FIGS. 9A and 9B are enlarged diagrammatic views of a variation of pump end embodiment of FIGS. 8A and 8B for use in the liquid delivery system of FIG. 1, with FIG. 9B showing the ejection of an ink droplet from the system.
Figure 9B:
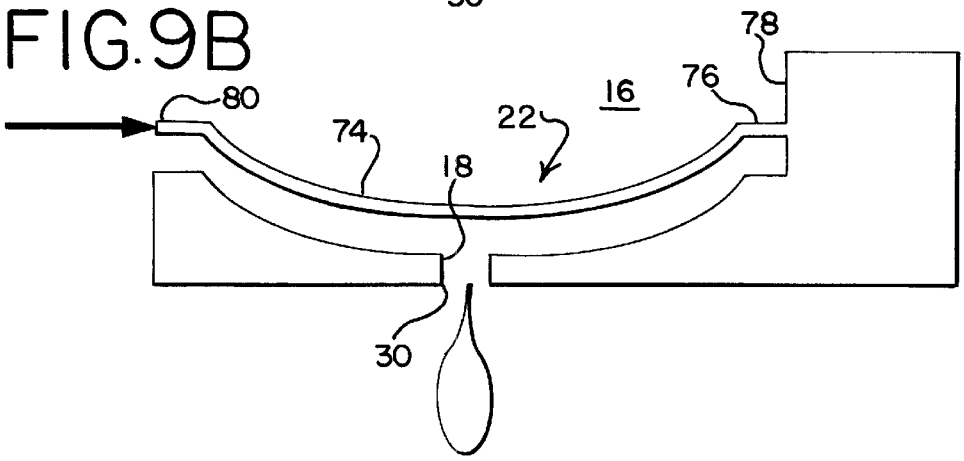
Figure 10:
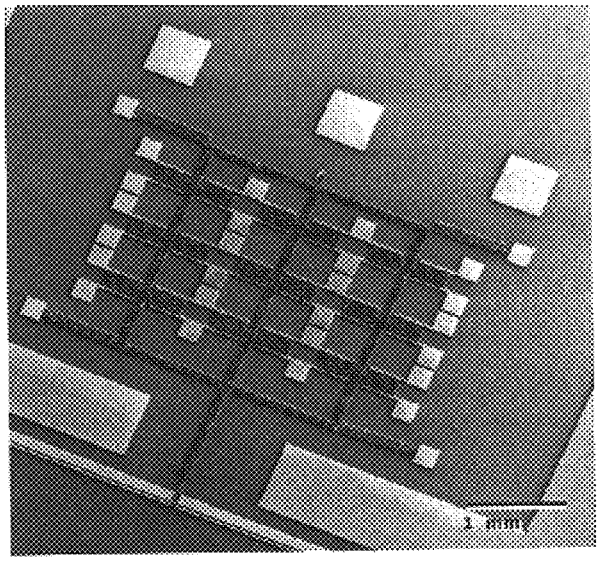
FIG. 10 is a SEM photograph of the liquid delivery system of FIG. 1.
Figure 11:
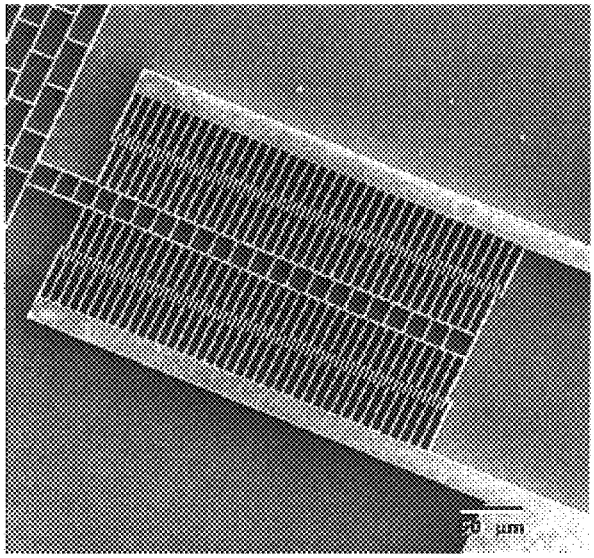
FIG. 11 is a SEM photograph of one of the comb capacitors for an actuator in the liquid delivery system of FIG. 1.
Figure 12:
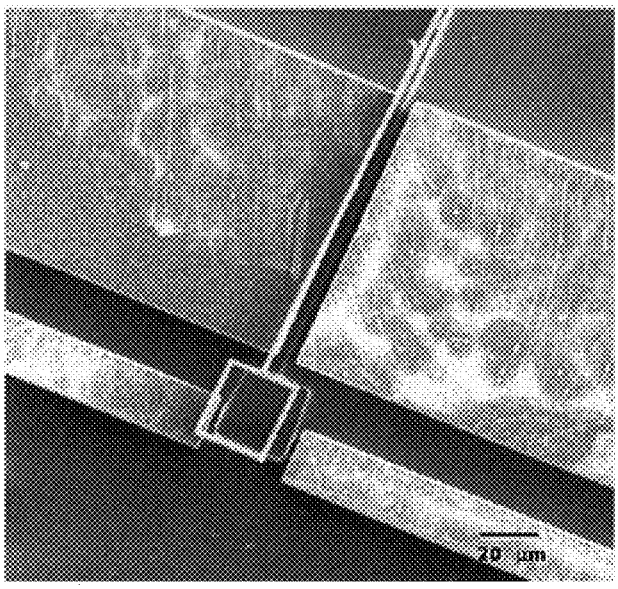
FIG. 12 is a SEM photograph of the pump end embodiment of FIG. 3.
Figure 13:
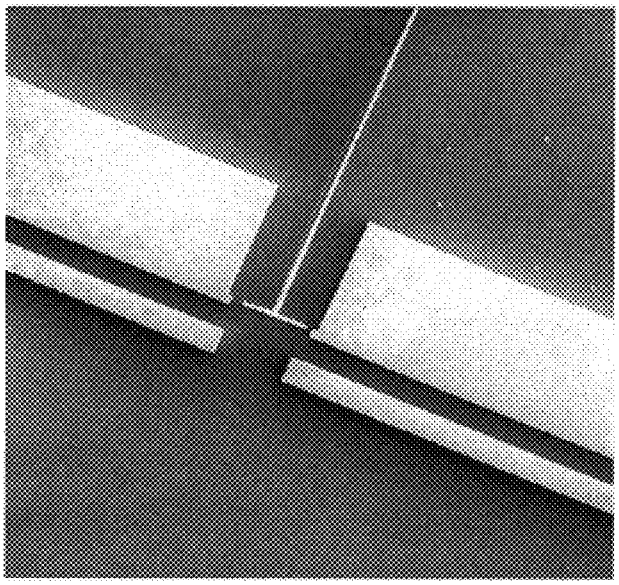
FIG. 13 is a SEM photograph of the pump end embodiment of FIG. 4.
Figure 14:
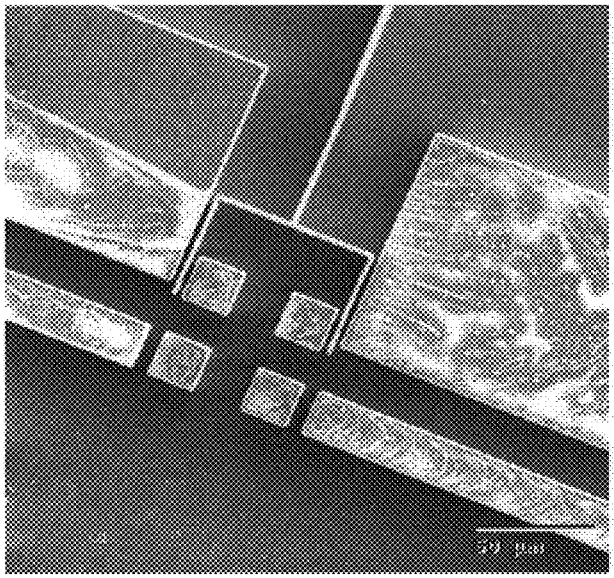
FIG. 14 is a SEM photograph of the pump and embodiment of FIG. 5.
Figure 15:
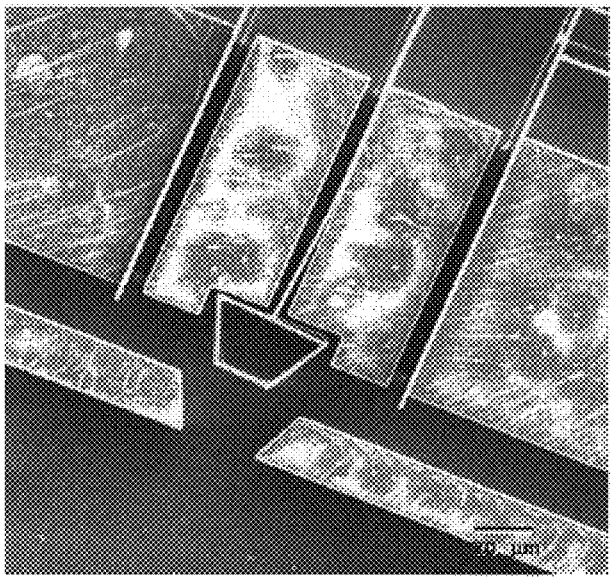
FIG. 15 is a SEM photograph of the pump end embodiment of FIG. 6.

With reference to FIGS. 9A and 9B, an embodiment similar to that of FIGS. 8A and 8B is shown. However, in this embodiment, the elongated member 74 is moved between its first position (FIG. 9A) and second (FIG. 9B) position by buckling the member 74. To this end the connecting rod applies a force to the elongated member 74 generally in line with its long axis, as indicated by the arrow. As seen in FIGS. 9A and 9B, the interior of the chamber that the elongated member closely overlies when in its second position may have a shape complimentary to that of the buckled elongated member.

Accordingly, a liquid delivery system has been provided that meets the objects of the invention. While the invention has been described in terms of certain preferred embodiments, there is not intent to limit it to the same. Instead, the invention is defined by the scope of the following claims.

What is claimed:

1. A liquid delivery system fabricated on a substrate for delivery of a metered amount of liquid on demand comprising:

at least one liquid source;

a chamber including a nozzle having an outlet through which liquid is expelled from the system;

a microchannel for connecting the liquid source to the chamber;

a pump for transporting liquid from the liquid source to the chamber;

a moveable member for applying positive pressure to the liquid in the chamber so as to force a metered amount of liquid through the outlet of the nozzle; and a reciprocating mass operatively connected to the moveable member to move the member back and forth.

2. The liquid delivery system of claim 1 wherein the moveable member comprises a generally 3-sided, U-shaped structure having first and second spaced-apart sides, each sized and shaped to fit through the outlet of the nozzle, and a third side connecting the first side to the second side, the structure being reciprocable between a first position inside the chamber and a second position outside the nozzle so that as the structure moves from inside the nozzle through the outlet, a liquid film forms on the open area defined by the structure and liquid in excess of that forming the film forms a drop.

3. The liquid delivery system of claim 1 wherein the moveable member comprises a 4-sided generally rectangularly-shaped structure with opposed open sides, with first and second spaced-apart sides having lateral edges and being sized and shaped to fit through the outlet of the nozzle, the third and fourth spaced-apart sides connecting the lateral edges of the first and second spaced-apart sides, the structure being reciprocable by the moveable member between a first position inside the chamber and a second position outside the chamber, so that as the structure moves through the outlet of the nozzle a liquid film forms across the open sides, with the liquid in excess of that forming the film forming a drop.

4. The liquid delivery system of claim 1 further comprising at least one valve to substantially seal the chamber from the microchannel, and the moveable member comprises a generally flat plate with top and bottom sides defined by top and bottom edges, respectively, the bottom side being submerged beneath a surface of the liquid in the chamber, the flat plate being reciprocable between a first position in which substantially no force is exerted by the plate on the surface of the liquid to a second position exerting a force on the surface of the liquid, the surface tension of the liquid with respect to the top edge of the plate being such that as the plate exerts pressure on the liquid, liquid does not move across the top edge of the plate onto the top side of the plate, and liquid is forced out through the nozzle.

5. The liquid delivery system of claim 4 wherein the chamber includes an opening sized to receive the flat plate, the plate being sized and shaped to substantially fill the opening.

6. The liquid delivery system of claim 1 wherein the moveable member includes a portion that seals the microchannel from the chamber as the moveable member moves from a first position to a second position where liquid is forced through the outlet of the nozzle.

7. The liquid delivery system of claim 1 further comprising at least one valve to seal the chamber from the microchannel, and the moveable member comprises a tapered plunger, with the outlet having a shape complementary to the plunger.

8. The liquid delivery system of claim 1 wherein the nozzle includes edges that are engaged by the moveable member and the moveable member comprises a flat plate sized so that as the plate passes through the chamber, the plate engages the edges of the nozzle to seal the nozzle from the microchannel, flexing of the flat plate causing liquid to be expelled through the outlet of the nozzle.

9. The liquid delivery system of claim 1 wherein the moveable member comprises an elongated member having an axis with a first end secured to a support interior of the chamber and a second free end, the elongated member being moveable between a first position spaced from the nozzle to a second position closely overlying the nozzle so that the metered amount of liquid is forced through the outlet of the nozzle as the elongated member moves from its first position to its second position.

10. The liquid delivery system of claim 9 wherein the reciprocating mass is operatively connected to the free end of the elongated support to apply a force to the structural member generally perpendicular to its axis.

11. The liquid delivery system of claim 9 wherein the reciprocating mass is operatively connected to the free end of the elongated support to apply a force to the structural member generally in line with the axis, the structural member buckling as it moves from its first position to its second position.

* * * * *